US007251930B2

(12) United States Patent
Audouin

(10) Patent No.: US 7,251,930 B2
(45) Date of Patent: Aug. 7, 2007

(54) SYSTEM FOR TRIGGERING THE PURGING OF NOX TRAP DEPOLLUTION MEANS

(75) Inventor: Arnaud Audouin, Paris (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 11/312,284

(22) Filed: Dec. 20, 2005

(65) Prior Publication Data

US 2006/0130467 A1 Jun. 22, 2006

(30) Foreign Application Priority Data

Dec. 22, 2004 (FR) ..... 04 13754

(51) Int. Cl.
*F01N 3/00* (2006.01)

(52) U.S. Cl. ..... 60/285; 60/276; 60/277; 60/295; 60/297

(58) Field of Classification Search ..... 60/274, 60/276, 277, 285, 301, 295, 297; 701/103, 701/105, 107

See application file for complete search history.

(56) References Cited

U.S. PATENT DOCUMENTS 5,402,641 A * 4/1995 Katoh et al. ..... 60/285
6,138,453 A * 10/2000 Sawada et al. ..... 60/277
6,304,812 B1 10/2001 Kolmanovsky et al.
6,308,515 B1 * 10/2001 Bidner et al. ..... 60/274
6,327,847 B1 * 12/2001 Surnilla et al. ..... 60/274
6,370,868 B1 4/2002 Kolmanovsky et al.
6,637,190 B1 * 10/2003 Pott ..... 60/274
6,763,657 B2 * 7/2004 Wachi et al. ..... 60/285
6,854,266 B2 * 2/2005 Schnaibel et al. ..... 60/276
2003/0115858 A1 6/2003 Hahn et al.
2004/0144085 A1 7/2004 Surnilla et al.

FOREIGN PATENT DOCUMENTS

DE 10007048 A1 8/2001
DE 10255488 A1 6/2004
DE 102004002896 A1 8/2004
EP 0829623 A 3/1998

* cited by examiner

*Primary Examiner*—Tu M. Nguyen
(74) *Attorney, Agent, or Firm*—Nicolas E. Seckel

(57) ABSTRACT

A system for triggering purging of depollution means including a NOx trap and integrated in a vehicle diesel exhaust line comprises respective elements for establishing: a first coefficient representing the extent to which the trap is full of NOx; a second coefficient representative of the capacity of the trap to reduce the NOx as a function of its temperature; a third coefficient representative of the capacity of the engine to purge the trap as a function of the engine operating point; and a fourth coefficient representative of the capacity of the engine to purge the trap as a function of the corresponding excess fuel consumption; together with a device for combining these various coefficients in order to obtain a fifth and final coefficient, and a comparator for comparing the fifth coefficient with a threshold so that in the event of the threshold being exceeded, a request is issued to trigger purging of the trap.

6 Claims, 7 Drawing Sheets

SYSTEM FOR TRIGGERING THE PURGING OF NOX TRAP DEPOLLUTION MEANS

The present invention relates to a system for triggering the purging of depollution means comprising a NOx trap and integrated in a diesel engine exhaust line for a motor vehicle.

BACKGROUND OF THE INVENTION

It is possible to obtain a significant reduction in the NOx emitted by a diesel engine while in operation by post-treatment of the exhaust gas using a catalyst of the NOx trap type.

Such a catalyst operates on the principle of enabling NOx to be stored in the catalyst by forming a stable complex of the $Ba(NO_3)_2$ type.

This storage of NOx then takes place while the engine is operating normally on a lean mixture, i.e. with excess oxygen.

Once the catalyst is saturated in NOx, it becomes necessary to purge it so as to reduce the amount of NOx stored in the trap.

This can be done, for example, by switching the operation of the engine from a lean mode to a rich mode, i.e. a mode with excess fuel.

Storage efficiency decreases as the trap becomes filled with NOx. Consequently, it is possible to obtain NOx conversion that differs depending on the spacing between purges and on the duration of such purges.

Similarly, the quantity of NOx that can be stored in a trap is not constant, since it depends on the temperature of the catalyst, and thus on the temperature of the exhaust gas from the engine.

Thus, for example, a single lean/rich operating sequence, e.g. 100 seconds (s) with a lean mixture and 5 s with a rich mixture, leads to conversion that differs depending on the temperature at which the sequence is performed.

Finally, the engine can be operated in rich mode (e.g. in order to reduce NOx) only under certain running conditions of the vehicle.

Consequently, optimizing NOx conversion in a NOx trap needs to take account of various parameters relating to the operation of the engine, e.g. to physical magnitudes, etc. . . . Deciding when to trigger and when to stop purges is a key factor governing the performance of the post-treatment system, i.e. the NOx conversion that is achieved, the associated extra consumption of fuel, the penalty in terms of other pollution emitted, . . . .

Applying a NOx trap to a diesel-engined vehicle thus requires strategies that enable purges to be managed autonomously. These strategies must be defined in such a manner as to optimize the various services expected of the system.

In practice, these strategies are implanted in a computer, e.g. an engine control computer, and they are intended to control the operation of the catalyst in interaction with the other strategies involved in controlling the engine.

Various methods and systems have already been envisaged for optimizing such purges.

OBJECT AND SUMMARY OF THE INVENTION

The object of the invention is to further improve such systems.

To this end, the invention provides a system for triggering purging of depollution means comprising a NOx trap and integrated in a motor vehicle diesel exhaust line, the system comprising:

means for establishing a first coefficient representing the extent to which the NOx trap is full of NOx;

means for establishing a second coefficient representing the capacity of the NOx trap to reduce the stored NOx as a function of its temperature;

means for establishing a third coefficient representative of the capacity of the engine to purge the NOx trap as a function of the engine operating point;

means for establishing a fourth coefficient representative of the capacity of the engine to purge the NOx trap as a function of the corresponding excess fuel consumption;

means for combining said coefficients to obtain a fifth and final coefficient; and comparator means for comparing the fifth and final coefficient with a threshold so that in the event of the threshold being crossed, a request is issued to trigger purging of the NOx trap.

According to other characteristics of the invention:

the means for combining the coefficients comprise means for multiplying them together;

the threshold can be adjusted;

the various means for establishing coefficients comprise models respectively modeling: temperature; NOx emission; the NOx trap; and fuel consumption; and said models include maps.

BRIEF DESCRIPTION OF THE DRAWINGS

The invention can be better understood on reading the following description given purely by way of example and made with reference to the accompanying drawings, in which.

MORE DETAILED DESCRIPTION

The present invention thus relates to a strategy for deciding when to start purging a catalyst forming a NOx trap belonging to depollution means integrated in an exhaust line of a motor vehicle diesel engine.

This decision needs to take account not only of parameters associated with the operation of the engine, but also parameters associated with the operation of the catalyst forming the NOx trap.

The strategy described herein is integrated in an assembly for controlling the operation of the engine in the form of a module referred to as a "deNOx supervisor".

The decision whether or not to trigger a purge is then based on parameters associated with the operation of the engine that are measured, and also on physical magnitudes that are modeled, such as, for example: a temperature model; a NOx emission model; a NOx trap model; an excess fuel consumption model; etc.

The decision to launch or trigger a purge is then transferred to a module referred to as a "deNOx controller" serving to control purging proper, e.g. by triggering a change in the parameters controlling the operation of the engine, when purges are performed by switching the engine to operate in a rich mode after previously operating in a lean mode.

Figure 1:
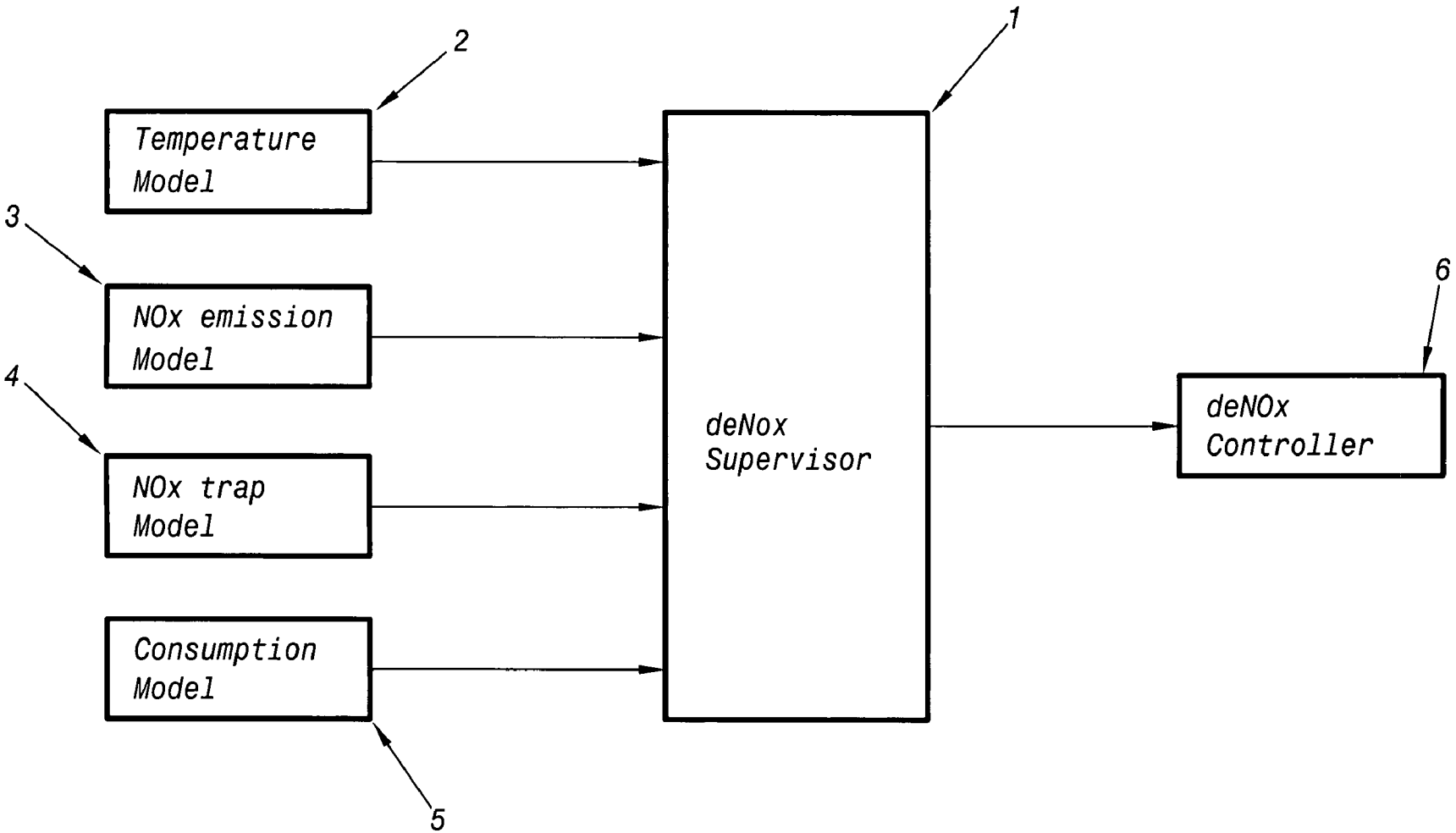
FIG. 1 is a block diagram showing the general structure of a system of the invention.

The deNOx supervisor module which decides when to launch a purge, and the way in which it is integrated in control of the engine are described with reference to FIG. 1.

In this figure, the deNOx supervisor is given overall reference 1, and receives as inputs information coming from modules given overall references 2, 3, 4, and 5 and serving respectively to model temperature, NOx emission, the NOx trap, and fuel consumption.

The deNOx supervisor 1 has its output connected to a deNOx controller given overall reference 6.

As stated above, the decision to purge the trap needs to take account of various parameters. It can be difficult to define a decision strategy that is effective under all running conditions of the vehicle.

The concept on which the invention is based is to represent the appropriateness of running a purge by means of a plurality of coefficients (real numbers in the range 0 to 2). The decision to launch a purge is then taken when the product of the various coefficients exceeds a calibrated threshold.

Figure 2:
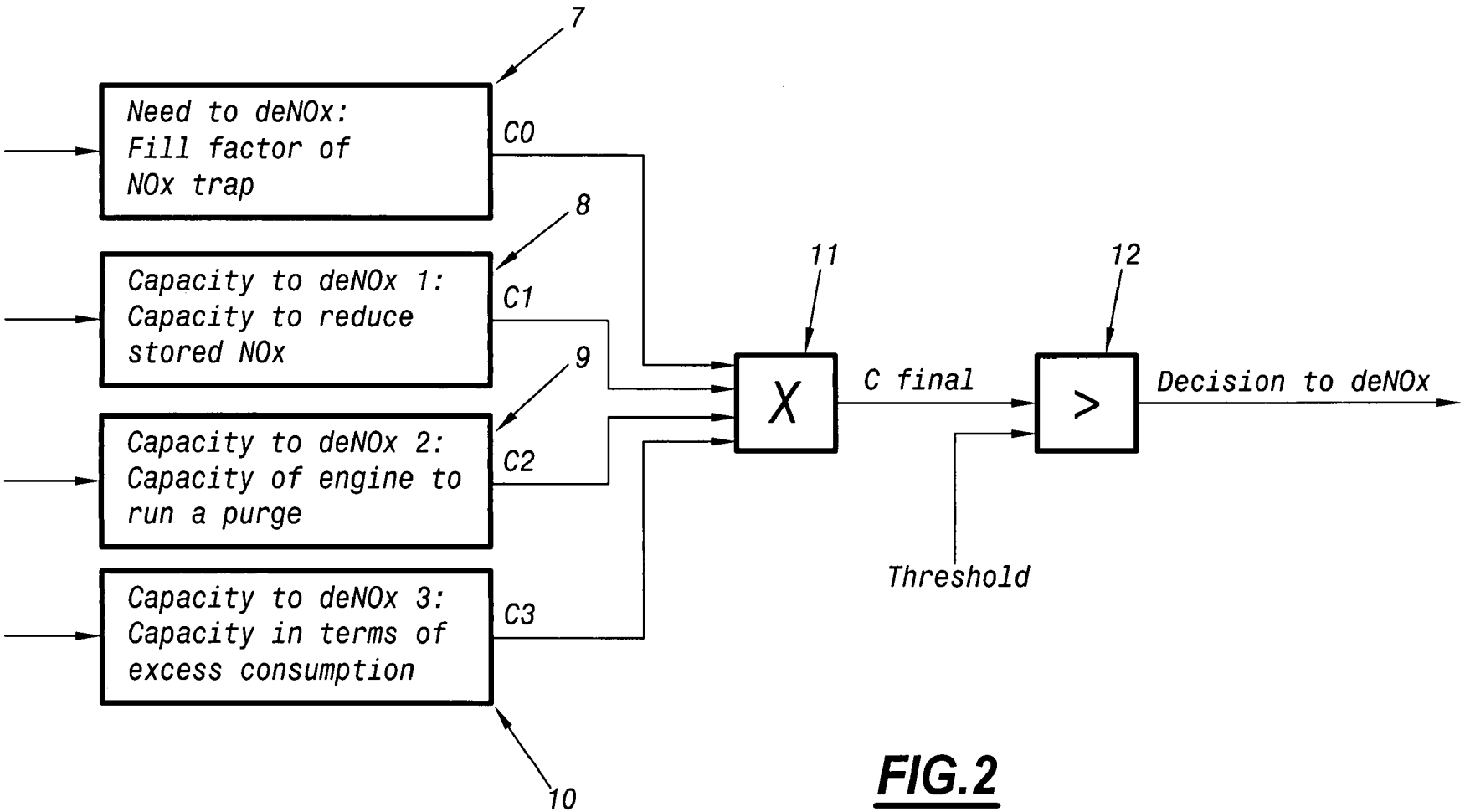
FIG. 2 is a block diagram showing various elements constituting such a system.

This is illustrated in FIG. 2.

This figure shows the use of various coefficients C0, C1, C2, and C3 which represent two categories of coefficients, relating firstly to the need to purge the trap in order to maintain a high degree of NOx conversion, and relating secondly to the possibility of performing such a purge of the trap while still complying with other services that the system is to provide, for example in terms of excess fuel consumption, emitting other pollution, ease of driving the vehicle, etc.

These various coefficients are determined as a function of physical magnitudes as measured or as modeled, and as a function of operating parameters of the engine.

The first coefficient C0 is a coefficient representing the degree to which the NOx trap is full of NOx.

This coefficient is delivered by a corresponding module given overall reference 7.

As the NOx trap fills up, its efficiency decreases so it becomes necessary to purge it. In practice, the coefficient C0 is established by dividing the mass of NOx, e.g. as modeled in the NOx trap model, by the storage capacity of the trap, where storage capacity is a function that depends on the temperature of the trap.

The coefficient C1 delivered by a corresponding module 8 represents the capacity of the NOx trap to reduce the stored NOx, as a function of the temperature of the trap.

Effective reduction of NOx, i.e. reduction that does not lead to high levels of CO/HC emissions, nor to excessive desorption of NOx itself, is obtained ensuring the temperature of the NOx trap is sufficiently high. This coefficient C1 is thus established as a function of the temperature of the NOx trap, e.g. as modeled in the temperature model. Typically, this coefficient C1 increases from 0 to 1 as the temperature of the trap increases.

The third coefficient C2 is delivered by a module given overall reference 9 and corresponds to the capacity of the engine to purge the NOx trap as a function of its operating point.

Purging the trap requires the engine to be operated in a rich combustion mode. This setting does not necessarily cover the entire operating range of the engine (for example rich combustion can become unstable at low load). Similarly, it can be preferable in terms of driving comfort to perform purging at certain operating points only, such as, for example: while accelerating as opposed to when the vehicle is traveling at a stabilized speed.

In practice, this coefficient C2 is determined by using a map or chart that depends on the engine speed and on the rate at which fuel is being injected.

The fourth coefficient C3 is delivered by a module 10 and represents the capacity of the motor to purge the NOx trap as a function of the corresponding excess consumption of fuel.

Operating the NOx trap must not lead to excessive extra consumption, i.e. the extra consumption must not exceed 5% or 6% for example. Purging inevitably leads to excess consumption, so purges are allowed only if the excess consumption, e.g. as determined in the excess consumption model, remains below an adjustable threshold.

Typically, C3 has the value 1 if purging is allowed, and the value 0 otherwise.

These four coefficients are then combined, e.g. by being multiplied together in a multiplier given overall reference 11, so as to deliver a fifth coefficient referred to as the "final coefficient", C final which is compared in comparator means 12 with an adjustable threshold value.

A request to purge the NOx trap is then launched when the fifth coefficient C final becomes greater than the threshold as set.

The above-described strategy has been developed and implanted in a diesel development vehicle. One of the intended targets was to make a high NOx conversion rate available on a motor vehicle emission group (MVEG) approval cycle without excessively degrading other services.

The strategy used thus had to make it possible to satisfy those requirements in robust manner. This has been achieved by calibrating various curves and maps that determine the coefficients C0, C1, C2, and C3, and also the threshold value with which the fifth coefficient C final is compared. The values of the various coefficients as calculated over the MVEG cycle are given by way of example in FIGS. 3 to 7.

Figure 3:
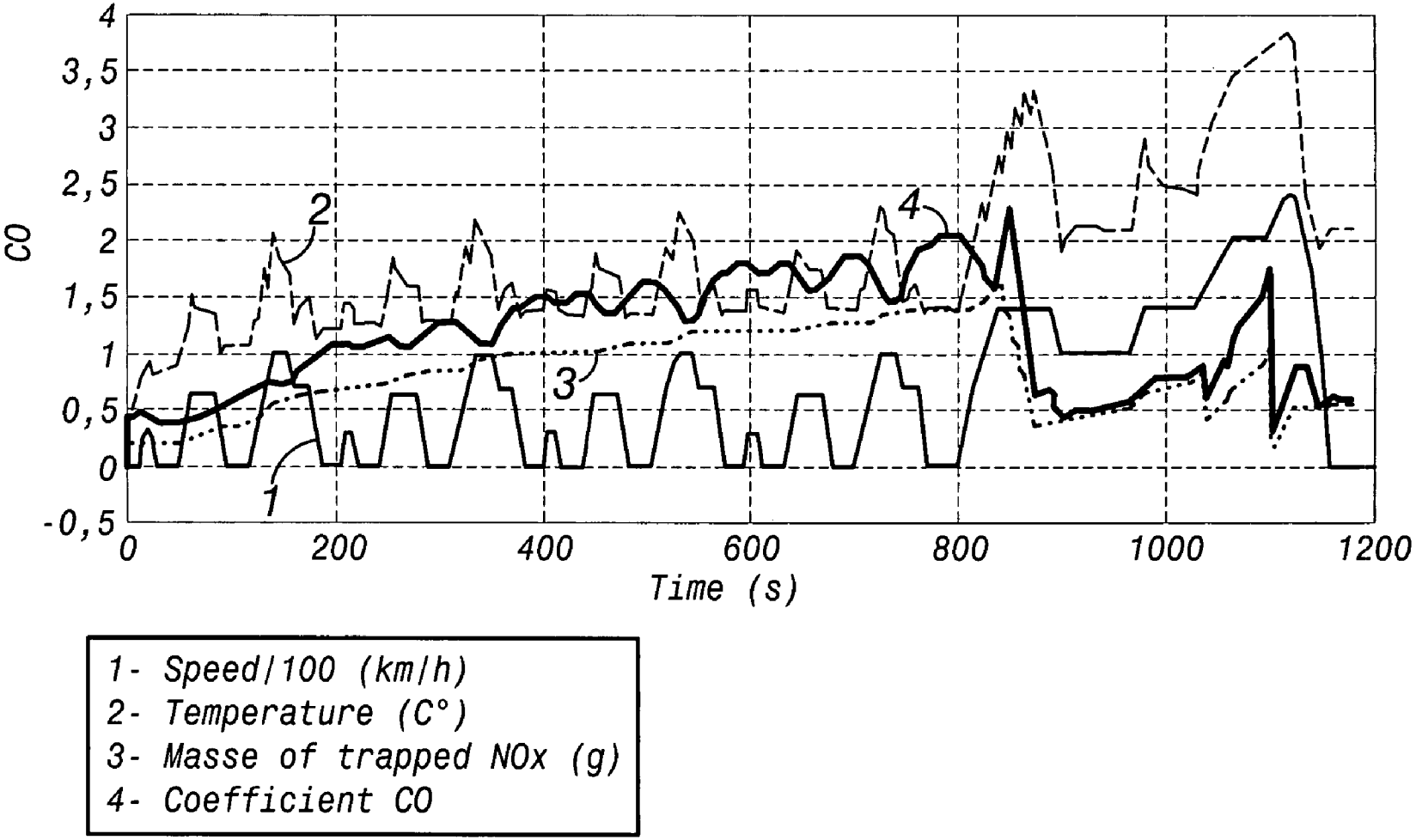
FIGS. 3, 4, 5, 6, and 7 are graphs showing how the various coefficients implemented in a system of the invention vary as a function of time.

It can be seen in particular in FIG. 3, which relates to the first coefficient C0, that in the urban portion of the cycle, i.e. in the time range 0 to 800 s, the temperature, and thus the storage capacity of the NOx trap, are relatively low.

As a result the trap fills up quickly and the first coefficient C0 is relatively high. On the non-urban portion of the cycle, i.e. in the time range 800 s to 1200 s, the temperature and thus the storage capacity are higher. However the quantity of NOx being emitted is high and the trap fills up quickly. The first coefficient C0 thus increases very quickly after each purge.

Figure 4:
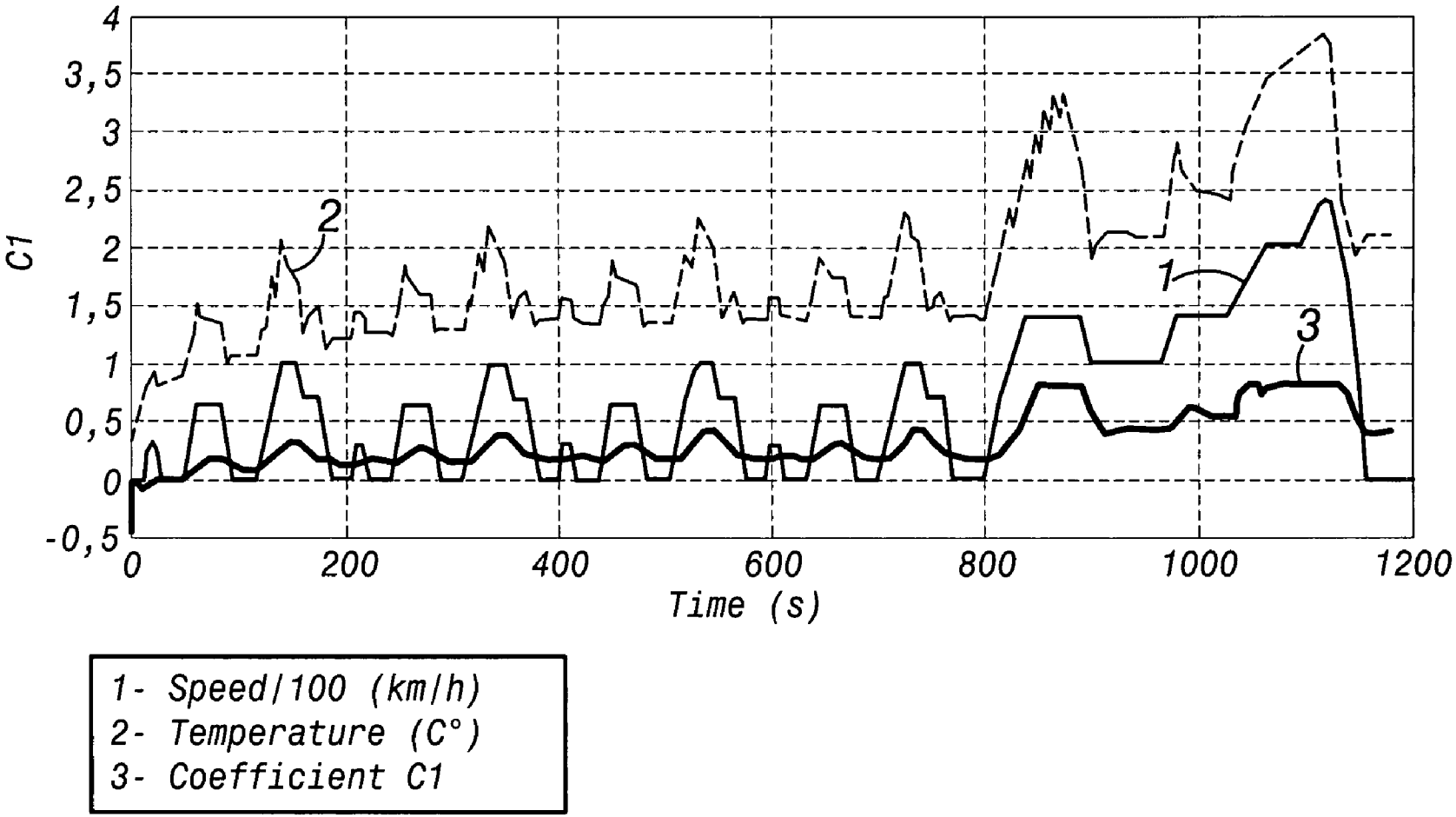

FIG. 4 shows variation in the second coefficient C1. In the urban portion of the cycle, it can be seen that the temperature is relatively low and that the value of the second coefficient C1 is thus quite low. In the non-urban portion of the cycle, the temperature is higher, leading to a higher value for C1.

Figure 5:
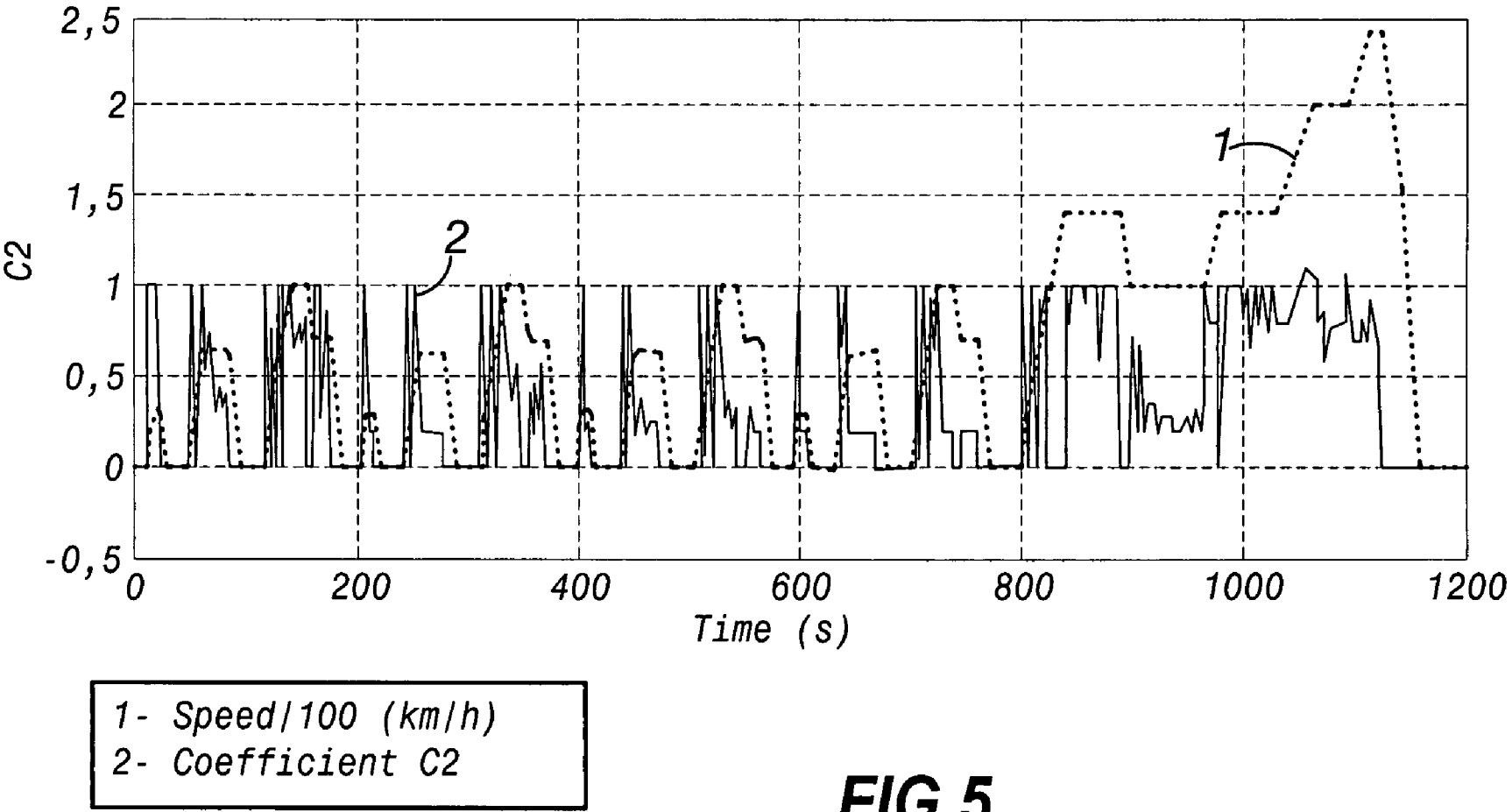
Figure 6:
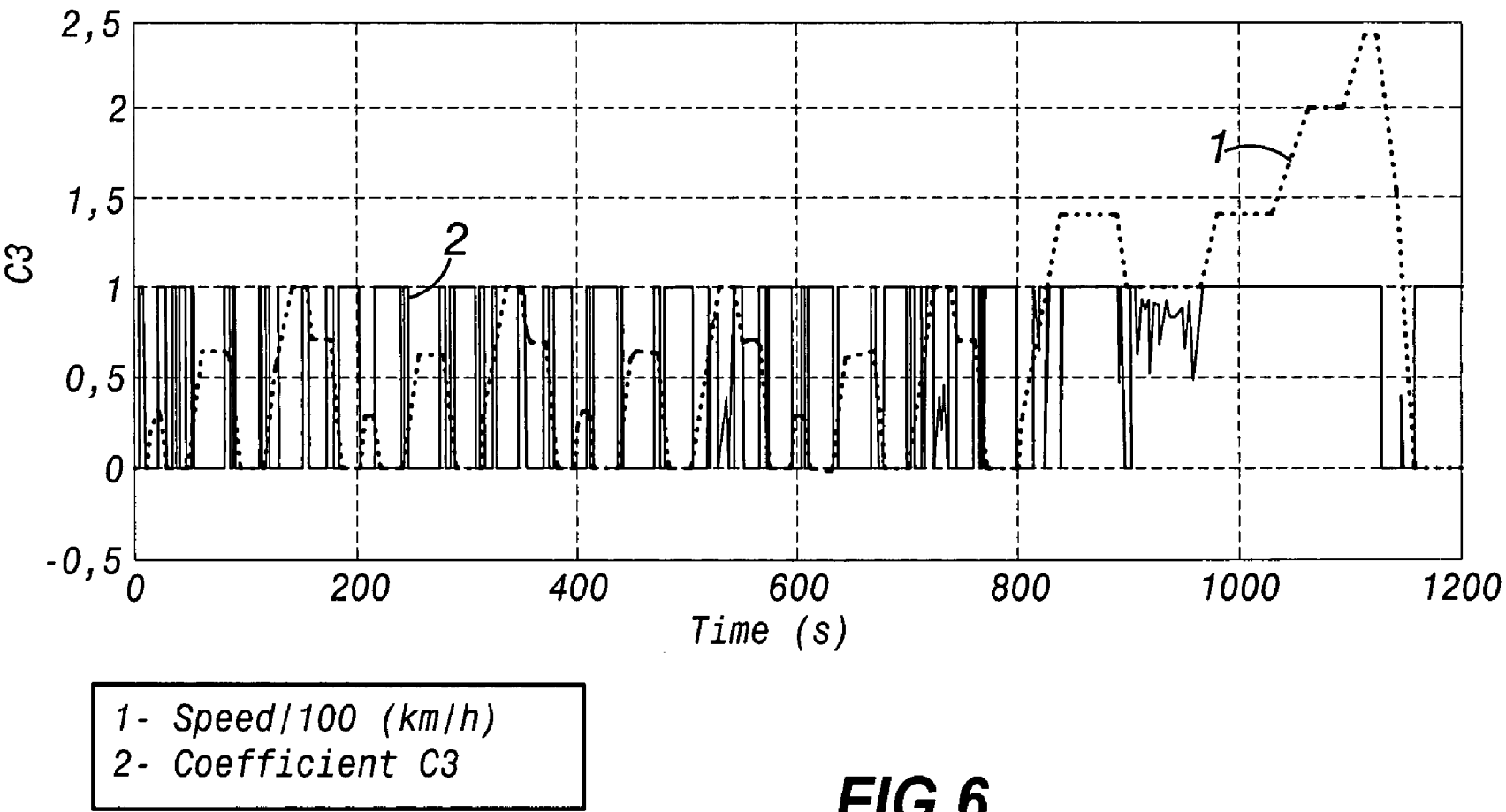

FIGS. 5 and 6 show variations in the third and fourth coefficients C2 and C3. In the urban portion of the cycle, triggering purging on stable speeds would be unfavorable in terms of over-consumption, since purging takes longer because both the exhaust gas temperature and the flow rate are low. The value of C3 is zero. When the temperature becomes more favorable, or once running conditions become more favorable, the value of C3 switches to 1, in the range 800 s to 845 s. While purging is taking place, the coefficient C3 is at 0, thereby preventing any further purging, until excess consumption has returned under the threshold as set.

Figure 7:
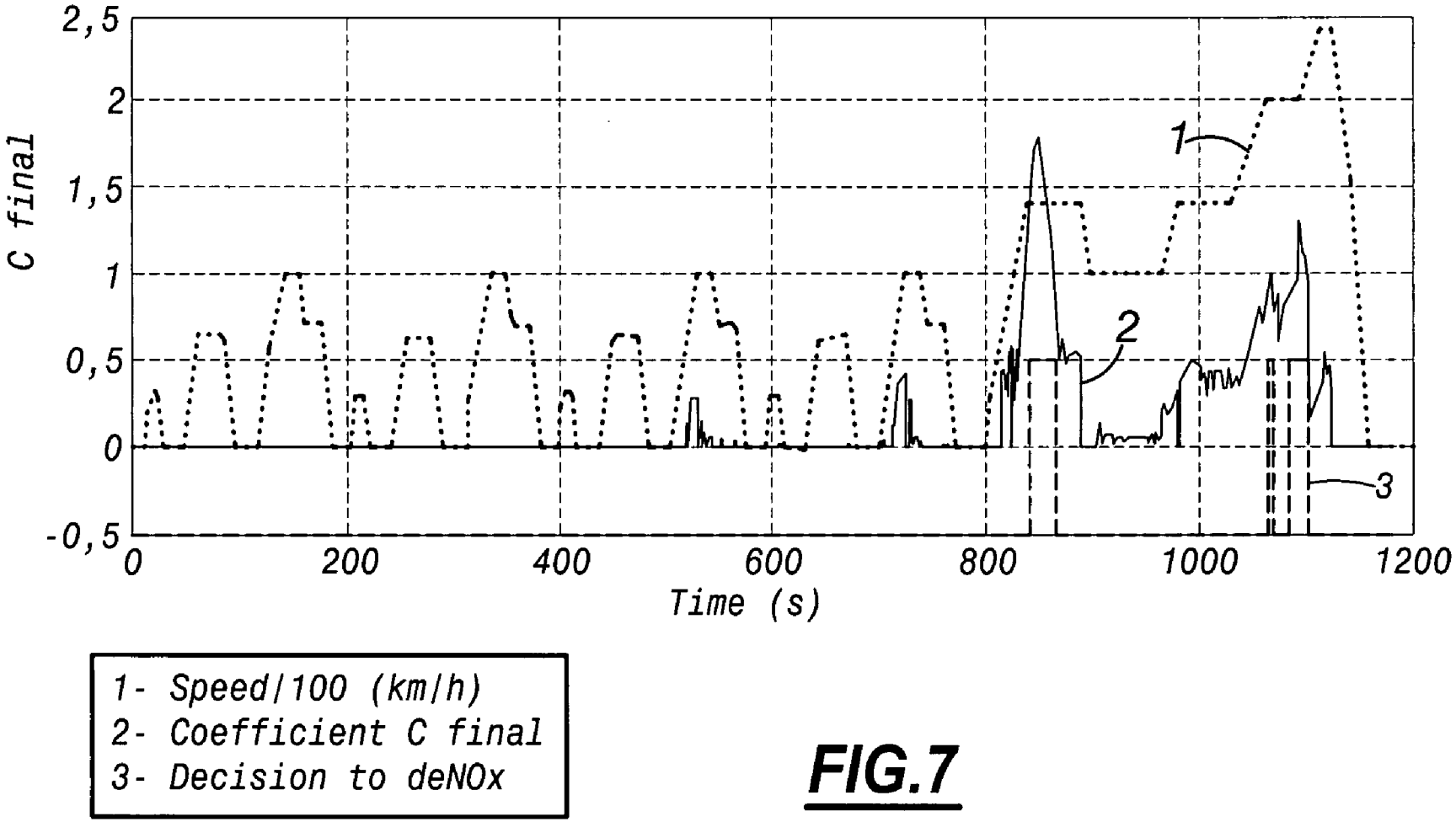

FIG. 7 shows the variation in the fifth coefficient C final and the decision whether or not to purge the NOx trap. The product of the coefficients C0 to C3 as described above thus leads to the fifth coefficient C final as shown in FIG. 7. The threshold is set to a value of 0.9, for example. Once the coefficient C final exceeds 0.9, a purge is triggered on request.

It can thus be seen that the coefficients C0, C1, C2, and C3 make it possible to take account of all of the needs and capacities of the system, when deciding when to purge NOx, and to optimize the services provided by the system.

In addition, the calibration of the mapping curves determining the coefficients C0, C1, C2, and C3 makes it possible to define strategy over an approval cycle with a good degree of robustness. The decision is taken in a manner that is relatively insensitive to dispersions from one cycle to another or one vehicle to another.

It will thus be understood that the system of the invention presents various advantages, in particular compared with the strategies of deNOx supervisors that are presently in production, with this being because they use different logic to reach a decision.

In such prior art supervisors, the decision is taken by comparing a parameter with a threshold. For example, if the mass of NOx is greater than a threshold for a given operating point, then a purge is triggered. Comparisons can also be made with a plurality of thresholds, e.g. launching a purge if the mass of NOx is greater than a threshold and if the running conditions are favorable.

In other words, prior art supervisors make use of a finite number of conditions in order to reach a decision concerning purging.

In the system of the invention, the strategy that is proposed is different since there exist an infinite number of circumstances under which the decision can be taken. Each parameter is associated with a weight that can vary continuously. The decision is taken by multiplying the weights together (without any hierarchy) and it is therefore likewise continuous. The major advantage of this technique is that it makes it possible in simple manner to take account of a large number of parameters while reaching the decision, thereby enabling the decision to be optimized under all conditions under which the system can exist.

Furthermore, the selected parameters and the means selected for giving them respective weights (curves, charts, etc. . . . ) are very well adapted to operation of a NOx trap. This makes it possible to satisfy the numerous services that are expected of the system with a good degree of robustness.

Naturally, still other embodiments could be envisaged.

What is claimed is:

1. A system for triggering purging of depollution means comprising a NOx trap and integrated in a motor vehicle diesel exhaust line, the system comprising:

means for establishing a first coefficient representing the degree to which the NOx trap is full of NOx;

means for establishing a second coefficient representing the capacity of the NOx trap to reduce the stored NOx as a function of the NOx trap's temperature;

means for establishing a third coefficient representative of the capacity of the engine to purge the NOx trap as a function of the engine operating point;

means for establishing a fourth coefficient representative of the capacity of the engine to purge the NOx trap as a function of the corresponding excess fuel consumption and as a function of current fuel consumption;

means for combining said coefficients to obtain a fifth and final coefficient; and comparator means for comparing the fifth and final coefficient with a threshold so that in the event of the threshold being crossed, a request is issued to trigger purging of the NOx trap.

2. A system according to claim 1, wherein the means for combining the coefficients comprise means for multiplying them together.

3. A system according to claim 1, wherein the threshold can be adjusted.

4. A system according to claim 1, wherein the third coefficient is a function of engine speed and of a rate at which fuel is injected.

5. A system according to claim 1, wherein the various means for establishing coefficients comprise models respectively modeling: temperature; NOx emission; the NOx trap; and fuel consumption.

6. A system according to claim 5, wherein said models include maps.

* * * * *